US009315374B2

(12) United States Patent
Merlin et al.

(10) Patent No.: US 9,315,374 B2
(45) Date of Patent: Apr. 19, 2016

(54) ADJUSTABLE FRAME FOR A RIDING SADDLE THAT DOES NOT REQUIRE DISASSEMBLY

(76) Inventors: Michel Merlin, Nevers (FR); Guadalupe Martiarena, Ciudad Autonoma De Buenos Aires (AR); Norberto José Di Ciancia, Provincia de Buenos Aires (AR)

( * ) Notice: Subject to any disclaimer, the term of this patent is extended or adjusted under 35 U.S.C. 154(b) by 98 days.

(21) Appl. No.: 14/236,953

(22) PCT Filed: Jul. 27, 2012

(86) PCT No.: PCT/FR2012/051785

§ 371 (c)(1),
(2), (4) Date: May 24, 2014

(87) PCT Pub. No.: WO2013/021115

PCT Pub. Date: Feb. 14, 2013

(65) Prior Publication Data

US 2015/0047302 A1 Feb. 19, 2015

(30) Foreign Application Priority Data

Aug. 5, 2011 (AR) ..... 2011 0102844

(51) Int. Cl.
*B68C 1/04* (2006.01)
*B68C 1/02* (2006.01)

(52) U.S. Cl.
CPC . *B68C 1/04* (2013.01); *B68C 1/025* (2013.01); *B68C 2001/048* (2013.01)

(58) Field of Classification Search
CPC ..... B68C 1/02; B68C 1/025; B68C 1/04; B68C 2001/042; B68C 2001/048
See application file for complete search history.

(56) References Cited

U.S. PATENT DOCUMENTS

| | | | | | |
|---|---|---|---|---|---|
| 15,744 | A * | 9/1856 | Plant | 54/44.3 |
| 38,404 | A * | 5/1863 | Nichols | 54/44.3 |
| 261,374 | A * | 7/1882 | Meanea | 54/44.1 |
| 1,246,675 | A * | 11/1917 | Stewart | 54/44.1 |
| 3,388,530 | A * | 6/1968 | Parker | 54/44.1 |
| 2010/0229507 | A1 * | 9/2010 | Strauss et al. | 54/44.3 |
| 2012/0180440 | A1 * | 7/2012 | Rynningen | 54/71 |

FOREIGN PATENT DOCUMENTS

| | | | | |
|---|---|---|---|---|
| DE | 16190 C | | 4/1881 | |
| DE | 83369 C | | 1/1895 | |
| DE | 2923002 | * | 12/1980 | B68C 1/00 |
| DE | 202010010216 U1 | * | 1/2012 | B68C 1/04 |
| GB | 190914892 | * | 0/1909 | B68C 1/00 |
| GB | 191309377 | * | 0/1914 | B68C 1/00 |
| WO | WO 2011101102 A1 | * | 8/2011 | B68C 1/02 |

OTHER PUBLICATIONS

Machine translation of DE 83369 to Petitfils et al., published Jan. 1895 (cited on May 23, 2014 IDS).*

* cited by examiner

*Primary Examiner* — Kathleen Alker
(74) *Attorney, Agent, or Firm* — Andrew W. Chu; Craft Chu PLLC

(57) ABSTRACT

The adjustable frame for a riding saddle includes a saddle tree arranged on a portion of a riding saddle and having two longitudinal arms and at least one rotatable continuous part, passing through the saddle tree. An upper portion of the rail is easily accessible without requiring the disassembly of any component. The opening and closing of the reinforcement parts of the saddle tree, that are driven by the rotatable continuous part using a simple Allen wrench, are enabled.

13 Claims, 6 Drawing Sheets

1
2
3
3a
3b
6
7
8
9
10
12
13
14
15
$P_o$

ADJUSTABLE FRAME FOR A RIDING SADDLE THAT DOES NOT REQUIRE DISASSEMBLY

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention is related to the field of the technique that includes trimmings, upholstery and the like. It refers more specifically to the riding saddles, also called rails, and the like. More particularly, the invention relates to the parts that make up the frame of said riding saddles or saddles and more specifically to the adjustment of said frame in order to fit different shapes within a determined range of adjustment.

In order to better understand the aim and scope of the present invention, the current state of the art should be described with reference to the riding saddles or rails of the type that in some way according to the specialist of the art constitute the prior art of the present invention.

2. Description of Related Art Including Information Disclosed Under 37 CFR 1.97 and 37 CFR 1.98.

There exist presently on the market a variety of riding saddles, also known simply as rails, which are used for riding animals such as horses and ponies, they have evolved so as to provide more comfort and greater functionality to their users. The rails are designed to mediate between the back of the animal that supports the full weight of the rider who sits on said animal. This is why the interaction between rider and the horse is favored or worsened by the quality and the shape of the rail.

The rails of recognized quality are fine upholstery products, in which the upholstered, blown and flexible parts together with the finishing materials are placed around a semi-rigid frame that ends up being contained in its interior. Said inner frame determines to a large extent the blocking of the rail on the horse's back, and in particular the type of support on the cross of the horse.

It should be noted that the shape of the back of the animal, on which the frame is placed can vary from one animal to another and may vary with the same animal over the years, this due to the change in weight of the latter, and can even have asymmetries of the very back of the horse.

Since a proper blocking on the cross of the horse ensures comfort and performance of both the horse and the rider, some modern rails incorporate a series of curved inserts, plates or blades or exchangeable or fixed metal reinforcements of different shapes and with different angles of opening. The exchangeable reinforcements are usually screwed onto the front deck of the frame, referred to as saddle tree. These metal reinforcements have the general shape of an reversed V and have a relationship mainly with the blocking on the back of the animal, since they change the angle and the general shape of the frame itself and accordingly determine the blocking on the cross of the horse. This change in the opening of the front deck or saddle tree of the frame itself is possible, since the frames, and in particular the saddles aimed at incorporating this kind of curved exchangeable reinforcements, are made of materials that are more or less flexible, in comparison with steel. These materials, such as wood, plastics, resins and composite materials, maintain certain flexibility, in comparison with the rigidity of steel, in order to be adapted to the new angle of opening that generally depends on the curved reinforcing part.

Many of the solutions proposed worldwide in this field and currently available on the market propose to insert reinforcements and/or devices for controlling to a more or less large extent the opening of the front saddle tree of the riding saddle. However, the vast majority of the latter require to disassemble significant portions of the rail or should have at the time of adjusting a set of ancillary parts to be exchanged in the frame itself. Although the current products have gradually incorporated improvements in this meaning, there still remains the need for having a rail that permits to be modified as regards the geometry of resting on the horse's back in a novel, accessible, fast and simple way, without the need for disassembling portions of the rail.

SUMMARY OF THE INVENTION

An object of the present invention is to provide a frame for a riding saddle that can adjust the degree of opening of the saddle tree in order to be adapted to different shapes of the cross of the horse.

Another object of the present invention is to provide a frame for a riding saddle that can adjust at least one saddle tree in addition to an adjusting position or point, thus permitting to adapt said at least one saddle tree to different needs of blocking on the horse.

Therefore, the object of the present invention is to provide a frame adjustable as to the opening of its saddle trees and/or similar parts, if necessary, in order to form a riding saddle adaptable to various needs of the user, in particular as regards the resting of the riding saddle on the horse, pony or the like.

Moreover, the object of the present invention is to provide an adjustable frame that needs not to be disassembled into its main components, permitting to have access to the desired adjustment in an accessible and easy way.

Therefore, the object of the present invention is to provide an adjustable frame for a riding saddle of the type having a saddle tree that is arranged in the front or rear portion of the frame of a riding saddle, connecting the two longitudinal arms of said frame so as to have at least one rotatable continuous part passing through said saddle tree, wherein said rotatable continuous part has at least one upper driving means, one external thread intended to be screwed into a threaded through-hole integral with said saddle tree and one lower driving part comprising at least one recess and, in a complementary manner, at least one driven reinforcement is generally connected at its lower end to said saddle tree and has its upper end accommodated in said at least one recess.

Further additional aims of the exemplary embodiments of the present invention will become clear in the section corresponding to the detailed description of the invention and the appended claims.

BRIEF DESCRIPTION OF THE DRAWINGS

For more clarity and a better understanding of the object of the present invention, the latter has been shown in several figures, in which the invention is shown according to at least one preferred embodiment, the whole by way of an example.

DETAILED DESCRIPTION OF THE DRAWINGS

Hereinafter is described in detail at least one embodiment of the present invention, in order to assist those skilled in the art to understand the advantages and at least one preferred form of implementation of the adjustable rail for a riding saddle.

Although the present description will be developed based on the attached figures, they should be taken by way of an example, and should in no way be taken as limiting the scope of protection of the present invention. In addition, although the adjustable frame (1) for a riding saddle will be explained by way of an example for the front portion or part of the saddle tree (2), this description is also valid for the rear portion (shown in broken lines in FIGS. 1, 4 and 7) or part of the frame (1) of the riding saddle and/or the equivalent parts.

Figure 1:
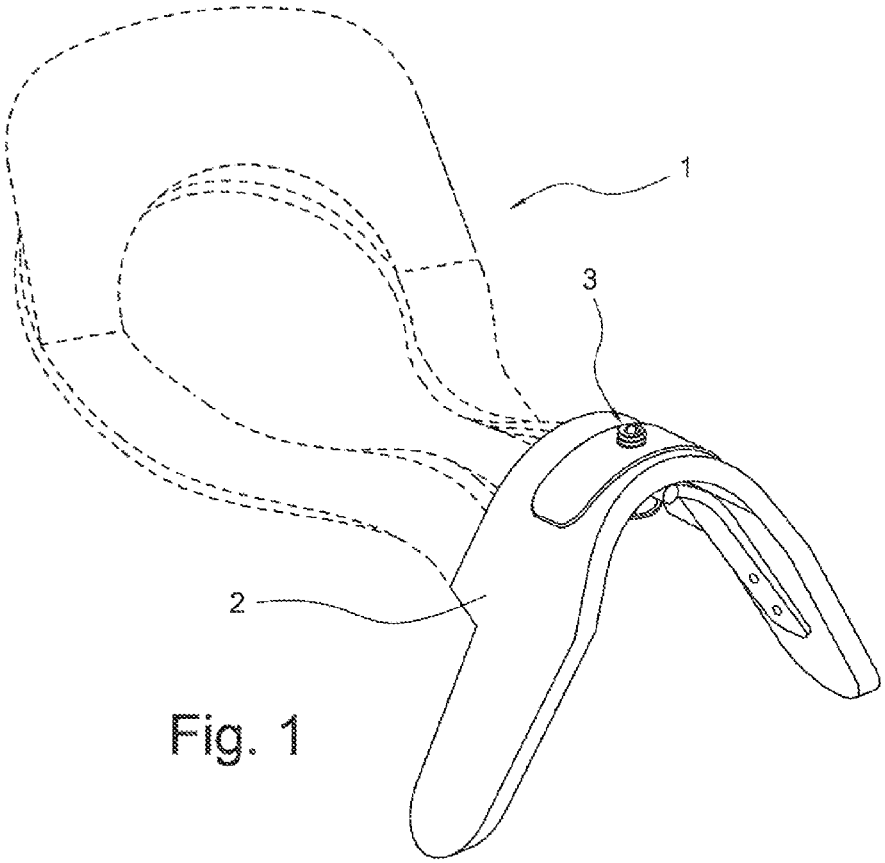
FIG. 1 is a perspective view of the frame of a riding saddle, wherein can be seen the general appearance it has according to the present invention, wherein the central and rear portion of the riding saddle is shown in broken line, in order to highlight the front saddle tree, where the new components enabling the adjustment are preferably positioned.

According to what is mentioned at the beginning, the frame (1) of a rail or riding saddle has the general appearance shown in FIG. 1. In said FIG. 1, we see a curved front portion, which we will refer to hereinafter as front saddle tree (2), or simply as saddle tree (2); said saddle tree (2) is integral with the rest of the frame (1) that develops towards the farthest rear part of the figure, in order to thereby provide the shape as a whole to the frame (1) or drum itself. It should be noted that, in general, the frame (1) or drum of a rail is generally formed by a front saddle tree (2) and a rear saddle tree (shown in broken lines in FIGS. 1, 4 and 7) connecting longitudinal arms in order to form said drum or frame.

In order to highlight only the portion of the frame (1) that is relevant for the present invention, the rest of the frame (1), except for said front saddle tree (2), is shown in broken lines. In said FIG. 1 is thus shown a front saddle tree (2) according to a preferred embodiment of the present invention.

In order to obtain a novel type of saddle tree (2) adjustable as to its opening, the present invention incorporates a completely novel concept for adjusting the opening of the front deck or saddle tree (2) with surprising results, as will be detailed below.

As best shown in FIG. 1, one identifies said front saddle tree (2), which is generally formed with a curved shape similar to the reversed letter "V". This shape being intended to match the geometry of the portion of the animal's back on which it rests, generally at the height of the cross of the animal.

This type of front saddle tree (2) can be manufactured of various rigid, semi-rigid or flexible materials, which can be rigidified by incorporating reinforcements in order to finally form a unique functional part that maintains its shape. For the purpose of the present invention, said front saddle tree (2) can be manufactured of various materials, either by bending, shaping, melting and/or injecting the materials in order to obtain the desired shape.

The front saddle tree (2) is preferably formed of plastic material, such that it is suitably flexible for the purpose of this invention. Notwithstanding, a variety of flexible materials may be used in the present invention, without any type of restriction, such as for instance wood, or a variety of composite materials known in the art. For the purpose of this invention, it is understood that a suitable flexible material will be the one that is suitable for being opened or closed within a useful range of angles of blocking on the horse's back while matching the adjusting means provided by the present invention, which is generally less flexible, that is more rigid than the material of the saddle tree (2). To this end, a plastic material as proposed as preferred embodiment permits to confer this flexibility to the saddle tree (2) when sufficient force is exerted thereon to change its shape. All this without prejudice to the possibility of using other materials suitable for the same purpose. Notwithstanding, the front saddle tree (2) of the present invention is preferably made of a plastic material, whereby the rest of the frame (1) can also be made of a plastic material and/or any other material known in the art.

Figure 3:
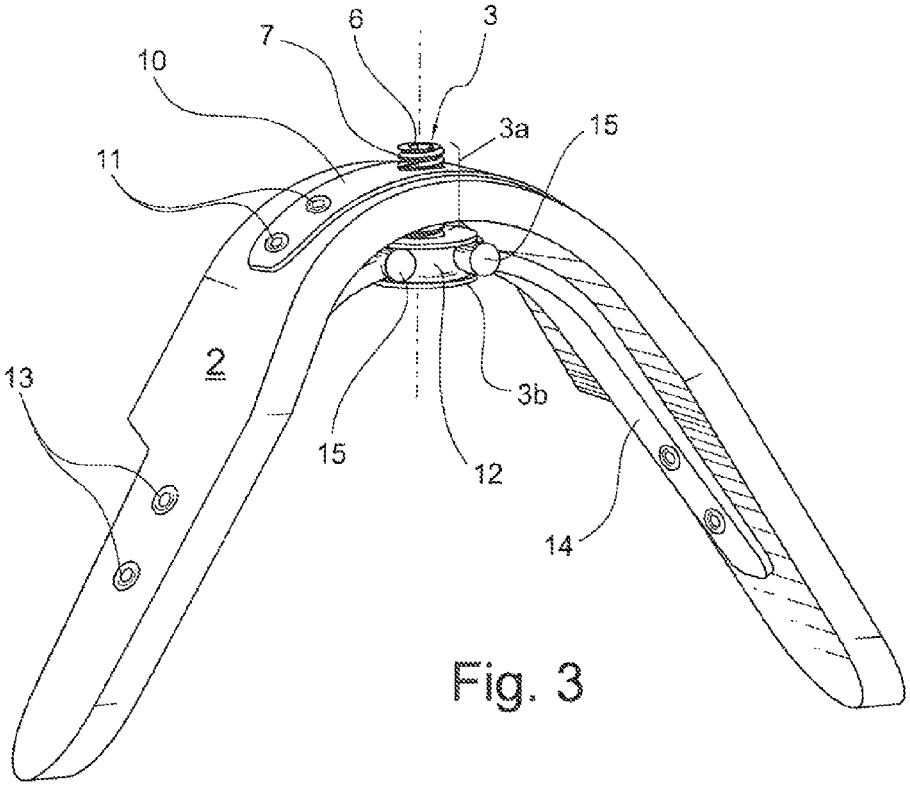
FIG. 3 is a perspective view taken from the front of the front saddle tree, in which we can see in more detail a preferred embodiment of the present invention.
Figure 4:
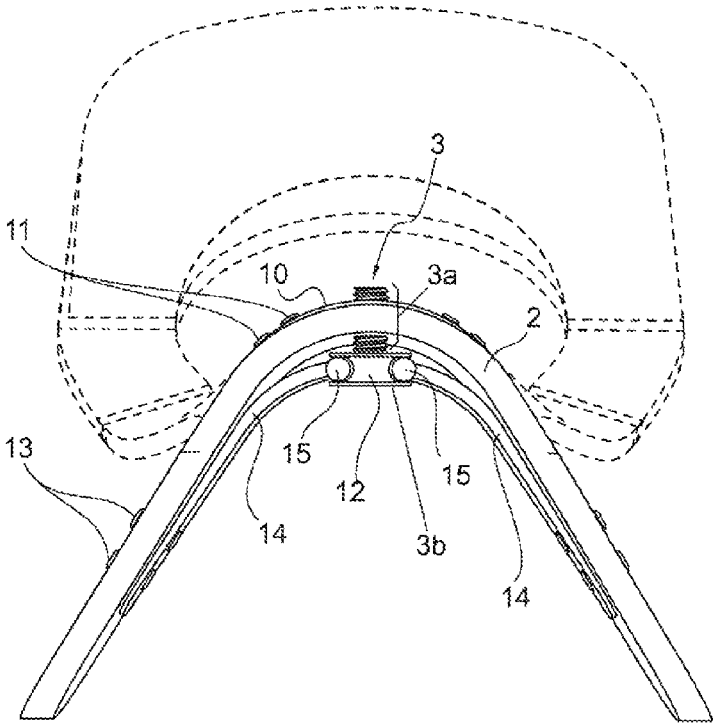
FIG. 4 is a front elevation view according to FIG. 1 and in correspondence with FIG. 3 of the preferred embodiment of present invention.

According to FIGS. 3 and 4, the reversed V-shaped front saddle tree (2) incorporates an adjusting part (3) that is continuously rotatable and passes through the saddle tree itself (2). For the purpose of this invention, the adjusting part (3) is a specially manufactured part in which can be identified, for the purpose of explanation, an upper portion (3*a*) and a lower portion (3*b*). (For a better understanding, see at the same time FIG. 6). The upper portion (3*a*) preferably includes at least one threaded part (7) and the lower portion (3*b*) comprises a lower driving part provided with at least one recess (12). Preferably, said recess (12) has the shape of a circumferential groove surrounding a wheel-shaped part, and the wheel rotates with the upper portion (3*a*). The associated rotation can be possible when the two portions (3*a*, 3*b*) of the part (3) are welded. As shown in the subsequent figures, said circumferential groove has a generally rounded, that is concave, hollow profile, as if it were a pulley or roller.

Figure 2:
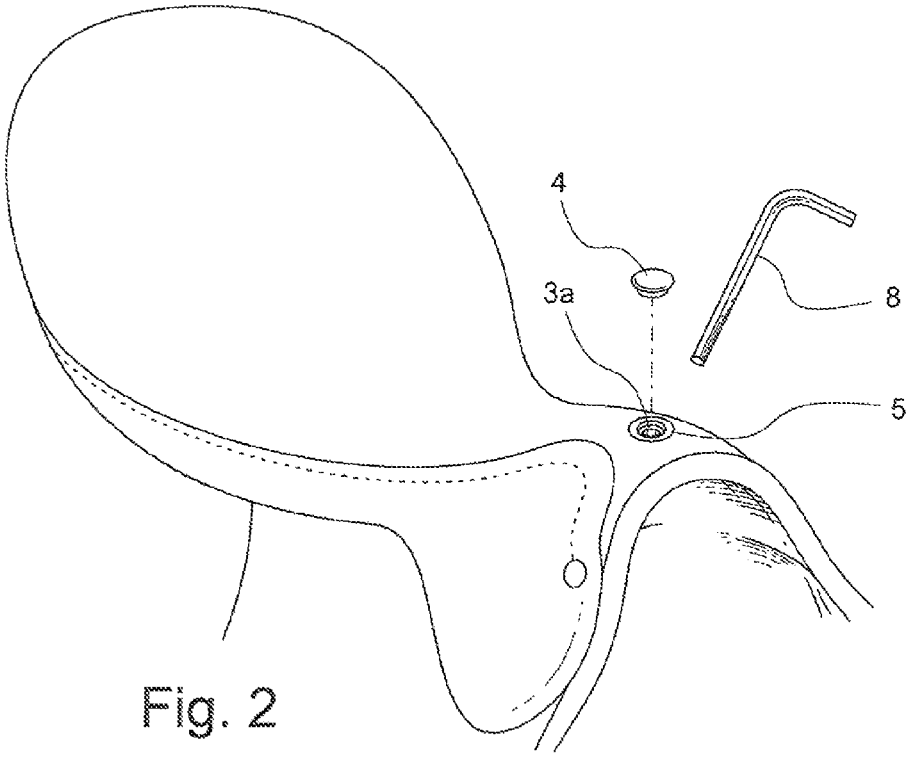
FIG. 2 is a perspective view based on FIG. 1, in which the upholstering and padding on said frame are already incorporated, in this way we can see the riding saddle already completed, which allows an easy adjustment through a small top opening.
Figures 5, 5A, 6:
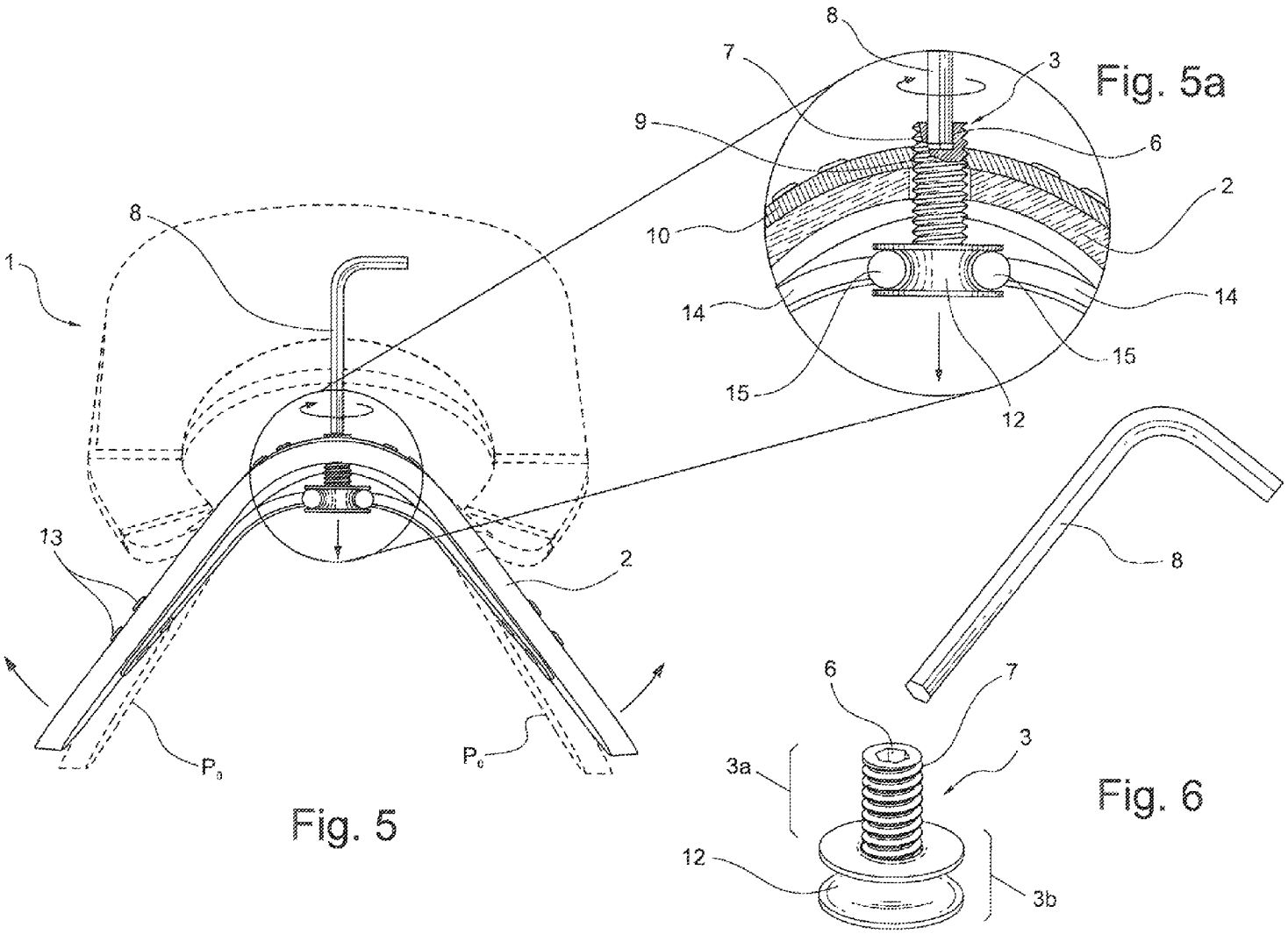
FIG. 5 is a front elevation view of the frame according to the present invention, according to the preferred embodiment, at the moment of adjusting of the opening in the front saddle tree, in particular during an adjustment of the angle of opening of the front saddle tree.
FIG. 5*a* is an enlarged and partly cross-sectional detail derived from FIG. 5, in order to better observe the mode of adjusting of the front saddle tree.
FIG. 6 is a perspective view of one of the main components of the present invention, showing the general aspect it has in a preferred embodiment, there is also shown a preferred adjustment tool such as an adjusting wrench known as Allen wrench.

The upper portion (3*a*) passes through the saddle tree (2) and protrudes through the top of the latter, as can be seen in FIGS. 1 and 2. This particular arrangement permits a convenient access to the upper portion (3*a*) in a direct and simple way by the user of the riding saddle, for example by simply removing a decorative cap (4) that closes, protects and decorates an opening (5) through which access is provided to the adjusting part (3). Preferably, the adjusting part (3) has, at a top end of the upper portion (3*a*), a driving means (6) in the form of a hexagonal recess or cavity, as best shown in FIGS. 5*a* and 6, which permits a tool (8) or hexagonal wrench of a corresponding size to enter and cause the screwing or unscrewing-relative to a tapped hole (9). It is obvious for those skilled in the art that other equivalent driving means (6) for obtaining an efficient rotation and torsion of the adjusting part (3) can be incorporated. There is a wide variety of types of screw heads and the like that are applicable in this meaning. It is even possible to incorporate a kind of support of the type butterfly with hinge, which allows sufficient grip by the fingers of the user to be able to cause the actual rotation of the adjusting part (3), thus forming a self-sufficient driving means (6), without the need for ancillary tools.

Notwithstanding, the incorporation of a deep-drawn hexagon is preferred and appropriate as driving means (6) for the adjusting part (3), since this is a compact solution, contributes to the ease of use and is a widespread and proven practice for obtaining good torsional rotation in a reduced space. Likewise, it is advantageous, because a tool (8) of this type are of wide application and availability.

Said tapped hole (9) is integral with said saddle tree (2), since it is preferably provided on a preferably metallic reinforcing part (10), which is united to the front saddle tree (2) by its adequate upper part, totally or partially overlapping with or deep-drawn in the saddle tree (2) and preferably in a portion of the saddle tree (2) that must not necessarily bend during the adjustment or setting of the angle of opening. Said joining can preferably be obtained by a plurality of joining means, such as for example rivets. Rivets as a joining means (11), are a suitable option and their use is widespread and proven in forming this type of reinforcement for riding saddles.

Although, by way of a preferred example, the tapped hole (9) is shown provided on the reinforcing part (10), there can be internal threads in the tapped hole (9) provided on either said reinforcement part (10) or the material of the saddle tree (2) itself. The reinforcing part (10) can be continuous with the body of the saddle tree 2 or have alternative combinations with the saddle tree 2, without this constituting any limitation, so long as the tapped hole (9) remains integral with said saddle tree (2). Likewise, said reinforcing part (10) may be manufactured of a variety of materials of sufficient hardness to ensure the integrity of the internal thread of the tapped hole (9), that is to avoid the erasure of the thread under load, without it having necessarily to be of metal. Likewise, other means for uniting with the saddle tree (2), besides the rivets as the joining means (11), can be implemented, as those skilled in the art will appreciate.

According to all that is stated above, and as best shown in FIG. 5*a*, we thus see that the adjusting part (3) is screwed by its upper portion (3*a*), more specifically its threaded part (7) with respect to the saddle tree (2), into the tapped hole (9), thereby enabling the raising and lowering of the adjusting part (3). In particular and according to said FIG. 5*a*, the adjusting wrench as a tool (8), referred to as Allen wrench, rotates in the clockwise direction when viewed from the perspective of the user, and the adjusting part (3) is lowered accordingly, separating the lower ends of the body of the saddle tree (2) itself.

Therefore and as best seen in FIGS. 3 to 5 and the enlarged detail in partial cross-sectional view 5*a*, the upper portion (3*a*) of the adjusting part (3) allows the interaction with the user in order to perform the desired adjusting action, simply exposing the opening (5) and using an adjusting wrench as a tool (8), as will be described in more detail below. This constitutes per se a novelty and a very appropriate advantage, since this does not require any type of disassembling of the coverings and coatings of the riding saddle itself.

In particular, the lower portion (3*b*) of adjusting part (3) is preferably in the shape of a wheel and that said wheel includes a recess (12) made in the form of a groove that extends over its circumference, as if it were in the form of a pulley or sheave, with the peculiarity that this circumferential groove permits to firmly accommodate into contact, but without joining of the upper ends (15) of a pair of driven reinforcements (14) that extend to both sides of the saddle tree (2) and below the latter.

Figure 7:
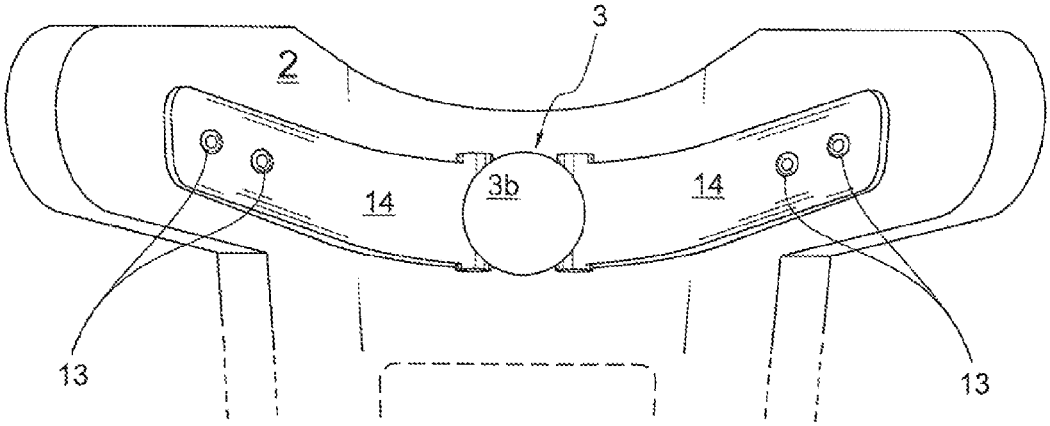
FIG. 7 is an elevation view taken from below of the front portion of the frame, in an assembly according to the preferred embodiment of the present invention.

For the purpose of the present invention, the driven reinforcements (14) have been implemented preferably with curved steel blades. The driven reinforcements (14) are parts that generally match the shape of the lower curve of the front saddle tree (2), as best shown in FIGS. 3 and 4, and are made of a harder, that is less flexible, material than the saddle tree (2), in order to condition the form of opening of the saddle tree (2). The driven reinforcements (14) are united to the saddle tree (2) proximate its lower ends by adequate connecting means (13), such as for example rivets, as best shown in FIG. 7, said rivet of the connecting means (13) being of proved usefulness for assembling frames for a riding saddle.

It is best seen in FIGS. 5 and 5*a* that the driven reinforcements (14) are made integral at their lower ends with the lower ends of the saddle tree (2) while maintaining a freedom of movement at the upper end (15). We thus see that the two upper ends (15) are accommodated in the groove-shaped recess (12) of the wheel-shaped driving part of the lower portion (3*b*). In this way, the upper ends (15) are driven up and down in relation to the rise and descent of the adjusting part (3).

According to the preferred embodiment of the present invention, the rotation of the adjusting part (3) includes the rotation of the lower portion (3*b*), whereby, although the circumferential groove of the recess (12) rubs against the two upper ends (15), this does not prevent the rotation and descent of the driven part (3). The groove of the recess (12) contributes to the fact that, once the position has been adjusted, the assembly has a tendency to remain firmly in its position, assisted by the friction due to the loading and clamping forces of the assembly during actual use of the riding saddle.

When adjusting part (3) moves downward, the upper ends (15) of the driven reinforcements (14) are also forced to descend, since they are driven downwardly by the recess (12) and, advantageously, the saddle tree (2) is forced to open, as shown in said FIG. 5. This situation is graphically shown in said FIG. 5, since in same the profile of the saddle tree (2)

before the rotation of the adjusting part (3) is also shown in broken lines and identified as (P0). Said profile (P0) could for example coincide with the initial shape of the saddle tree (2) when no kind of adjustment or tension is applied on the latter, that is in natural state.

Nevertheless, though an action of adjusting the opening of the front saddle tree (2) has been shown, the recess (12) of the lower portion (3*b*) also permits, on the other hand, to cause said upper ends (15) to rise, in order to force the closing of the saddle tree (2) with respect to said initial position (P0). This being said, it is obvious that the lower portion (3*b*), which is implemented by means of a wheel, determines what would generally be a lower driving part, and that said lower driving part includes at least one groove as the recess (12), which permits to move upward and downward the upper ends (15) of driven reinforcements (14).

Complementarily, the driven reinforcements (14) are, in turn, driven by their upper ends (15), while remaining at any time accommodated in said at least one groove of the recess (12). It is therefore obvious that the driven reinforcements (14) may be identified more specifically as driven reinforcements (14), since they have no possibility of adopting a specific position per se, but through the adjustment of the adjusting part (3).

Suitably, said upper ends (15) are implemented, as best shown in FIG. (8), in the form of cylinders or rollers, the size of which is adequate for permitting them to be accommodated in the recess (12) without too much backlash, but without excessive friction, both at the moment of using the riding saddle and at the moment of adjusting the opening of the saddle tree (2). In brief, said upper end (15) accommodated in said at least one recess (12) is without backlash, but allowing a relative rotation between the adjusting part (3) and said at least one driven reinforcement (14), in a way similar to a hinge, knee joint and the like. Therefore, from what is described herein can be deduced that those skilled in the art could achieve equivalent embodiments without therefore departing from the scope and spirit of what is described in the present invention.

Figure 8:
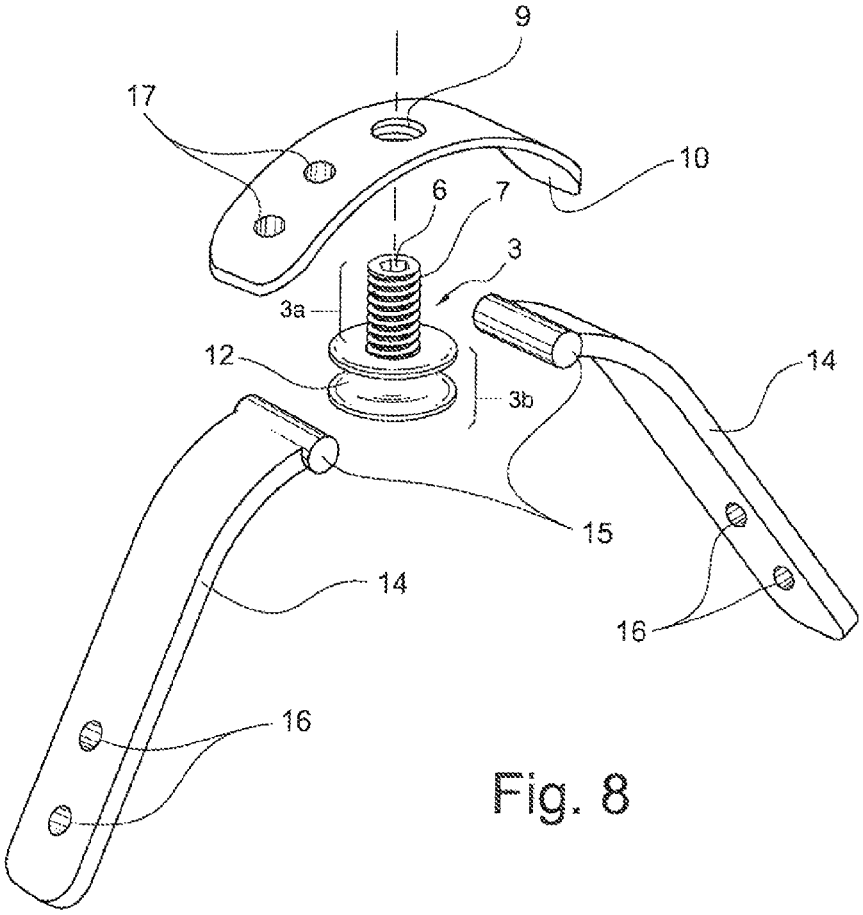
FIG. 8 is an exploded perspective view of the main components of the present invention according to a preferred embodiment, permitting more clarity of interpretation of the interaction of said components.

Once again and referring to FIG. 8, the components provide the saddle tree (2) with an easily accessible adjustment of the opening. Notwithstanding, once said components have been mounted on the saddle tree (2), they can be considered as being made integral with the saddle tree (2), since the upholstering and laminar finishing coatings cover and enclose the entire assembly and form in the eyes of the user a normal rail and the functionality of said rail remains such as the rider expects same to behave. This being said, the rider perceives a perfectly formed rail, but which has a form of adjustment that is surprisingly effective and easy to be operated and accessed using a simple wrench and without the need to disassemble any portion thereof.

Other constructional details of lesser relevance, such as the various through-holes (16), (17), can be made for securing the components to the saddle tree (2) using the aforementioned rivets. Likewise, various shapes, thicknesses, rounding and smoothing can be made on the components, such as on the driven reinforcements (14), so as to be better adapted to the particular shape of the saddle tree (2) involved.

Likewise, nothing prevents the incorporation of more than one lower portion (3*b*) in order to act on one or several driven reinforcements (14), and the changes obvious to those skilled in the art, who benefit from what is described and shown herein as regards the present invention.

By way of an example, FIGS. 9 to 14 show possible variations or modifications that can be applied to the present invention, generally in order to help further improving the performances of the frame(1) or to permit achieving other embodiments of the present invention.

Figure 9:
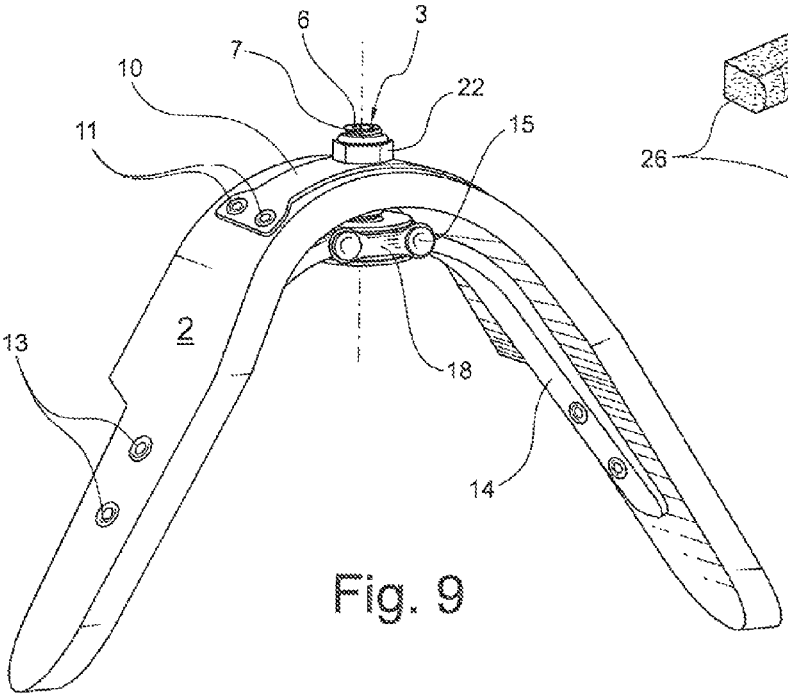
FIG. 9 is a perspective view taken from the front of the saddle tree, according to a new exemplary embodiment of the present invention, in which we can see the connecting links for the rollers, in order to further secure the assembly, comparable for reference to FIG. 3.

As shown in FIG. 9 of the example, it is possible to add, as an addition, a self-locking nut (22) or a set of two nuts (not shown) on the threaded part (7) of the adjusting part (3), in order to further secure the position of the adjusting part (3). In this way, it is possible, for example, to rotate the adjusting part (3) in the anti-clockwise direction, which thus permits to close the angle of opening of the two driven reinforcements (14) and, once the desired position has been achieved, to adjust said self-locking nut (22) in the clockwise direction, in order to complete securing the position of adjustment of the assembly according to said angle of opening.

Figure 10:
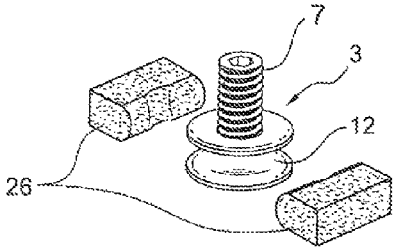
FIG. 10 is a partial sectional view of components of the present invention, highlighting the possibility of inserting intermediate or complementary parts in order to obtain an additional braking force by friction of the rotary adjusting part.

To this same end, it is also possible to incorporate a pair of friction parts (26), shown in FIG. 10 of the example, of different shapes and different materials, where said parts are usually inserted so as to enter under pressure into the recess (12), so as not to rotate together with the adjusting part (3), but, instead, to provide a friction to the rotation thereof. As a result, the friction parts (26) also contribute, complementarily, to securing the position of the adjusting part (3). Examples of materials used may be plastic, elastics, plush and dense foam materials among various options. Likewise, one can also carry out the incorporation of a kind of texture into the groove as the recess (12), in order to further ensure the friction with both said friction parts (26) and the rollers of the upper ends (15), the whole permitting to achieve an increase in friction of the parts.

Figure 11:
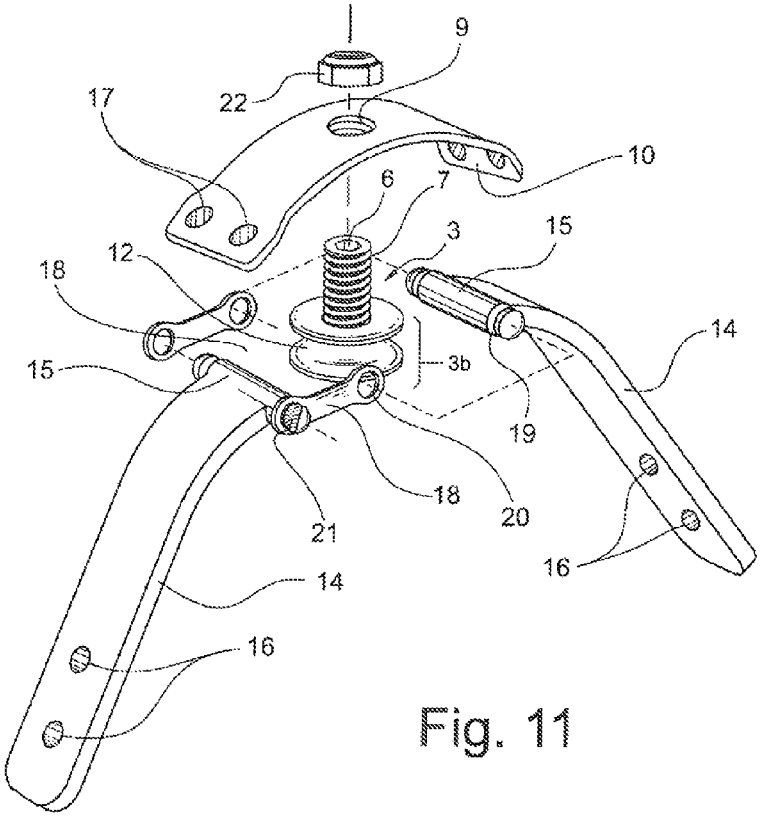
FIG. 11 is an exploded perspective view of the main components of the frame according to this new exemplary embodiment, comparable for reference to FIG. 8.

Moreover, in said FIGS. 9 and 11, there is a possible change of the arrangement of the through-holes (17) provided for in the reinforcing part (10), whereby, as said example shows, other arrangements and another number of perforations can be made without changing the performances of the present invention.

FIGS. 9 and 11 of the example show that the assembly is complemented with a pair of chain-like links (18), which act as a connecting part between the upper ends (15) of the two driven reinforcements (14). The chain-like links (18) are hinged in their connection with the rollers at the upper ends (15), so as to allow adjusting the opening of the blocking angle of the frame (1), as described above, but while helping to ensure the resting of the rollers at the upper ends (15) against the recess (12). It should be noted that, although this is not absolutely necessary, this permits notwithstanding, when needed, for example to reduce the depth of said groove, to modify the shape of said upper ends (15) and to provide the assembly with a much greater robustness, although this might not be necessary, permits to achieve additional strength for use in applications that exceed the normal use of this type of frames (1) for rails.

A way of implementing the incorporation of the chain-like links (18) is by means of flat links of the type used for example in bicycle, motorcycle and transmission chains, that is, generally a flat piece that is elongated and two perforations (20) intended to be inserted into as many recesses or a circumferential groove (19) are present in the rollers at the upper ends (15), so as to permit the relative rotation between said rollers at the upper ends (15) and the chain-like links (18), but maintaining constant the distance between the rollers at the upper ends (15). Once the chain-like links (18) have been mounted on the rollers at the upper ends (15), the latter can be held in position, with the sole aim of impeding the articulation between link and roller from being undone, but of permitting the rotation of the links with respect to said rollers at the upper ends (15). This is possible for example by means of sufficient riveting of the end of said rollers at the upper ends (15) to form a stop head (21), without preventing rotation between the parts. In this respect, in partial cross-sectional view is shown the additional material, which is obtained by this partial riveting of the ends of the rollers at the upper ends (15).

Figure 12:
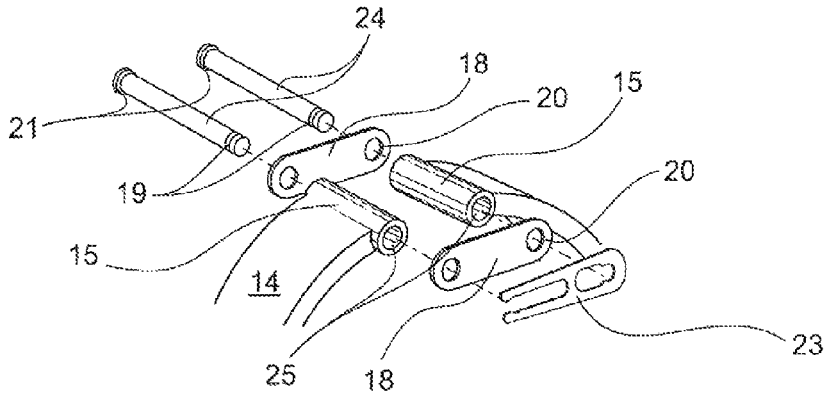
FIGS. 12-14 are perspective views of variants of the embodiment of the connection of said links, the whole according to the latter exemplary embodiment of the present invention.
Figure 13:
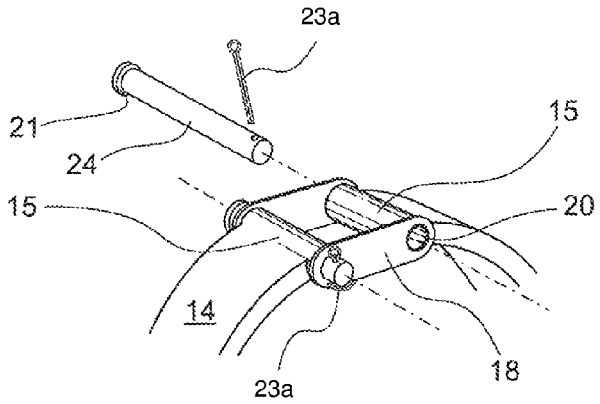
Figure 14:
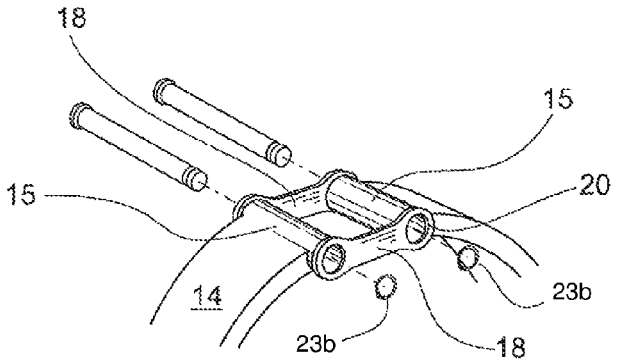

Notwithstanding, other forms of securing or incorporating the flat chain-like links (18) can be seen in FIGS. 12 to 14 of the example, where a variety of equivalent solutions are shown. In FIG. 12 are shown said rollers at the upper ends (15), this time with several through-holes (25), through which it is possible to slide or accommodate different rods (24) that include a stop head (21) at one longitudinal end and a circumferential groove (19) at the other longitudinal end. This being said, it is possible to pass through the holes (20) of each chain-like link (18), as shown in the figure, by means of rods (24), thereby fixing the assembly of links and rollers, and to finally fix the assembly by means of a retaining part (23) of the double-wedge type acting similarly to two springy metal rings for retaining each rod (24) shown in FIG. (14), except that in FIG. 12 the retaining part (23*b*) is a set of single rings, each ring being for each rod. Likewise, a similar configuration is achieved with a retaining part (23*a*) as a lock pin, a springy clip and/or an interference part that passes through the rod (24) like a key, as shown in FIG. 13. Thus, according to FIGS. 9 to 14 of the example, it was possible to show the modes of completion or modification that can be implemented in order to achieve technical variations of the present invention, without thereby modifying or changing the main object described and disclosed in the present application. Likewise, it is also possible to implement other changes or additions, while relying on the benefits of what is disclosed and described herein, such as for example by permitting the possibility of relative rotation between the upper portion (3*a*) and the lower portion (3*b*), but maintaining the vertical drive of the two assemblies, among other options.

Finally, it should be noted that, though the present invention has been shown and described preferably for being applied to the front saddle tree (2) of the adjustable frame (1) of a riding saddle, as those skilled in the art may appreciate, it is possible to extend this advantageous invention to both the saddle tree that is arranged in the front or rear portion of the frame and to other similar and/or equivalent portions, where it would be possible to incorporate the specific features defined below in the appended claims.

We claim:

1. A frame for a riding saddle, comprising:

a saddle tree being comprised of an inverted V-shaped body with lower ends forming an angle of opening and having a tapped hole at a top of said inverted V-shaped body;

an adjusting part passing through said tapped hole and being comprised of an upper portion and a lower portion fixedly mounted to said upper portion, said upper portion having a threaded part in threaded engagement with said tapped hole, said lower portion having a recess;

at least one driven reinforcement, each driven reinforcement being comprised of a lower end engaging a respective lower end of said saddle tree, and an upper end engaging said lower portion of said adjusting part, wherein said upper end of said at least one driven reinforcement has a roller releasably engaging said upper end with said recess, and wherein movement of said upper portion of said adjusting part by threaded engagement to said tapped hole corresponds to movement of said lower portion, wherein movement of said lower portion by contacting said lower portion to each upper end of said at least one driven reinforcement corresponds to movement of each respective lower end of said saddle tree so as to set said angle of opening of said saddle tree; and a rear portion connected to said saddle tree by two longitudinal arms.

2. The frame according to claim 1, wherein said upper portion and said lower portion of said adjusting part rotate together.

3. The frame according to claim 2, wherein said lower portion is comprised of a wheel-shaped part and the recess is comprised of a circumferential groove surrounding said wheel-shaped part.

4. The frame according to claim 1, further comprising:

a self-locking nut cooperative with said threaded part of said upper portion of said adjusting part so as to lock said angle of opening of the saddle tree.

5. The frame according to claim 1, further comprising:

at least one friction part removeably attached to said lower portion of said adjusting part so as to brake rotation of said adjusting part.

6. The frame according to claim 1, wherein each driven reinforcement extends below a specific side of each respective lower end of said saddle tree.

7. The frame according to claim 6, further comprising:

a pair of chain-like links, each chain-like link connecting upper ends of each driven reinforcement.

8. The frame according to claim 7, wherein each chain-like link comprises a flat piece, and two perforations in said flat piece, each perforation being cooperative with a respective circumferential groove at a corresponding upper end of each driven reinforcement.

9. The frame according to claim 8, wherein each circumferential groove is riveted at a corresponding longitudinal side of a respective upper end.

10. The frame according to claim 8, wherein each roller of each upper end is comprised of a cylinder, the frame further comprising:

a plurality of rods, each rod passing through a corresponding cylinder, each rod having a respective circumferential groove at a first longitudinal end and a stop head at a second longitudinal end of said rod; and a retaining part setting a respective circumferential groove of a corresponding rod on one side of each upper end of a respective driven reinforcement.

11. The frame according to claim 10, wherein said retaining part has a first connector and a second connector for respective circumferential grooves on corresponding rods.

12. The frame according to claim 10, wherein said retaining part is comprised of a lock pin removably passing through a respective first longitudinal end of a corresponding rod.

13. The frame according to claim 10, wherein said retaining part is comprised of a ring removeably attached to a respective circumferential groove at said first longitudinal end of a corresponding rod.

* * * * *